US009914567B2

(12) United States Patent
Brem et al.

(10) Patent No.: US 9,914,567 B2
(45) Date of Patent: Mar. 13, 2018

(54) DISPENSING CLOSURE, CONTAINER WITH A DISPENSING CLOSURE AND METHOD FOR MANUFACTURING A DISPENSING CLOSURE

(71) Applicant: Aptar Freyung GmbH, Freyung (DE)

(72) Inventors: Andreas Brem, Hinterschmiding (DE); Andreas Gross, Hohenau (DE); Markus Binder, Mauth (DE)

(73) Assignee: Aptar Freyung GmbH, Freyung (DE)

( * ) Notice: Subject to any disclaimer, the term of this patent is extended or adjusted under 35 U.S.C. 154(b) by 85 days.

(21) Appl. No.: 15/047,810

(22) Filed: Feb. 19, 2016

(65) Prior Publication Data

US 2016/0244215 A1 Aug. 25, 2016

(30) Foreign Application Priority Data

Feb. 20, 2015 (EP) ..... 15155921

(51) Int. Cl.
*B65D 43/02* (2006.01)
*B65D 47/20* (2006.01)
*B65D 47/06* (2006.01)

(52) U.S. Cl.
CPC ..... *B65D 43/0235* (2013.01); *B65D 43/02* (2013.01); *B65D 47/065* (2013.01); (Continued)

(58) Field of Classification Search
CPC ..... B65D 47/2006; B65D 47/04; B65D 47/20
(Continued)

(56) References Cited

U.S. PATENT DOCUMENTS 4,424,920 A * 1/1984 Tada ..... B65D 83/205 222/153.07
5,058,775 A * 10/1991 Gross ..... B65D 47/2006 215/235

(Continued)

FOREIGN PATENT DOCUMENTS

EP 0 292 882 B1 7/1992
EP 0926075 A1 6/1999

(Continued)

OTHER PUBLICATIONS

Third Party Observation for Appln. No. EP20150155921.

*Primary Examiner* — King M Chu
(74) *Attorney, Agent, or Firm* — Clark & Mortimer

(57) ABSTRACT

The present invention relates to a dispensing closure being attachable to a container for dispensing a flowable medium from the container, having a closure body having an outer skirt and a dispensing element being attached to the closure body and being pivotable relative to the closure body between a closed position and a dispensing position. The outer skirt of the closure body has an upper rim with a recess region, and the dispensing closure has a tamper evident band being positioned in the recess region and being attached to the upper rim via at least one frangible connection, wherein the tamper evident band is positioned in the recess region such that it is positioned at least partly between the upper rim and the extension portion of the dispensing element, so that the dispensing element cannot be moved into its dispensing position, before the tamper evident band is removed.

4 Claims, 5 Drawing Sheets

(52) U.S. Cl.
CPC .... *B65D 47/2006* (2013.01); *B65D 2101/003* (2013.01); *B65D 2543/00435* (2013.01)

(58) Field of Classification Search
USPC ..... 222/534, 536, 153.14, 153.06
See application file for complete search history.

(56) References Cited

U.S. PATENT DOCUMENTS

| | | | | | |
|---|---|---|---|---|---|
| 5,201,440 | A | | 4/1993 | Gross | |
| 5,284,264 | A | * | 2/1994 | Gross | B65D 47/2006 215/206 |
| 5,709,318 | A | * | 1/1998 | Oder | B65D 47/2006 222/153.06 |
| 6,152,329 | A | | 11/2000 | Rosenthal et al. | |
| 6,691,394 | B1 | * | 2/2004 | McClean | B65D 47/2006 222/534 |

FOREIGN PATENT DOCUMENTS

| | | | |
|---|---|---|---|
| GB | 1 333 334 | | 10/1973 |
| GB | 2 231 036 | A | 11/1990 |
| GB | 2231036 | A | 11/1990 |
| WO | 9936328 | A1 | 7/1999 |

* cited by examiner

DISPENSING CLOSURE, CONTAINER WITH A DISPENSING CLOSURE AND METHOD FOR MANUFACTURING A DISPENSING CLOSURE

FIELD OF INVENTION

The present invention generally relates to product packaging, in particular to packing of fluid products and the like. The present invention particularly relates to a closure for a container as well as to a container or parts or subunits of a container with such a closure and a method for manufacturing such a closure.

BACKGROUND OF THE INVENTION

Many different types of packages or containers are available for packaging of non-solid products of the type which are capable of flowing, such as fluids or fluidized materials, including liquids, pastes, powders, and the like, which substances are collectively and generically referred to herein also as "fluids".

There are different types of closures known in the art, one type of such closures are the so-called disc-top closures, which comprise a closure body and a dispensing element, said dispensing element being attached to said closure body and being pivotable between a closed position and a dispensing position.

Such disc-top closures are for example known from U.S. Pat. No. 5,341,960 or from U.S. Pat. No. 5,709,318.

It is an object of the present invention to provide a dispensing closure with provides an enhanced or alternative handling for the user and which especially enables an easy and secure handling by the user, whereas the closure provides a tamper evident function, indicating to the user whether the dispensing element has already been at least once switched or pivoted into the above-mentioned dispensing position or not.

BRIEF SUMMARY OF THE INVENTION

This object is solved by a dispensing closure according to claim 1 and a container with such a dispensing closure according to claim 12. The application also refers to a manufacturing method according to claim 15.

Claims 2 to 11 provide specifically advantageous realizations of a dispensing closure according to claim 1, wherein claims 13 and 14 refer to specially advantageous realizations of a container according to claim 12.

According to the present invention the dispensing closure is attachable to a container for dispensing a flowable medium from said container. There are multiple ways for attaching a dispensing closure to a container, especially around the opening of a container, e.g. providing an inner thread at an element of said dispensing closure and a corresponding outer thread on parts of said container, e.g. at a neck of a container forming the dispensing opening of said container.

The dispensing closure according to the present invention comprises a closure body having an outer skirt and a closure portion extending from the inside of said outer skirt, wherein said closure portion comprises a passageway for dispensing said flowable medium.

The side of the closure, at which the closure is attached to the container, which typically also has some kind of opening or free space to insert parts of a container, e.g. a neck of a container as mentioned above, is the underside or lower side or lower surface of the closure. The opposite side is the top side or upper side of the container. The outer skirt of the container forms the side surface or the side or lateral surface of the container.

A vertical direction is a direction extending from the lower side to the upper side of the closure, in case of e.g. a closure having a cylindrical form, e.g. with an outer skirt which is formed cylindrically, the vertical direction is parallel to the axis of the cylinder of the outer skirt.

An "outward direction" in the sense of this application is a direction being perpendicular to the vertical direction, from an inner part of the closure into an outer part of the closure, in case of a cylindrical closure and a cylindrical outer skirt the outward direction is a radial direction.

Said closure portion of said closure body extends preferably over the complete inner area or at least a major portion of said inner area of said outer skirt of said closure, and said closure portion may also comprise fastening means for attaching said dispensing closure to a container, for example an internal thread, which can interact with an external thread of a corresponding fastening means of said container, as mentioned above.

The closure portion also may contain various other elements, especially structural elements for e.g. providing stability to the closure body and the dispensing closure as a whole.

Said closure portion preferably has, at its lower side, i.e. at the side with which the dispensing closure is to be attached to the container, a free space or an opening to at least partly cover at least parts of the container, especially e.g. a neck of a container. The closure body preferably comprises a reception area or reception space at its lower side, which is arranged such that the dispensing closure can be securely attached to the container such that a fluid can exit through a dispensing opening of a container into and through the dispensing closure.

Said closure portion is arranged such that a passageway for dispensing said flowable medium is connected to an opening of a corresponding container, when said dispensing closure is attached to said container, preferably at a reception space, as mentioned above, so that fluid can be dispensed from said container through an opening of said container into said passageway of said closure portion.

The dispensing closure according to the present invention may also provide a tamper evident element, which indicates whether the dispensing closure has been demounted from the corresponding container or a neck of a container. Such a tamper evident element is different from a tamper evident element indicating to the user whether the dispensing element has been switched into the dispensing position or not.

The dispensing closure according to the present invention further comprises a dispensing element being attached to said closure body and being pivotable, relative to said closure body, between a closed position and a dispensing position. Said dispensing element further comprises a discharge opening.

Said closure body and said dispensing element are constructed and designed such that a flowable medium can be dispensed through said passageway of said closure body and through said discharge opening of said dispensing element, when said dispensing element is in its dispensing position, wherein the elements are constructed and designed such that the flowable medium cannot be dispensed, when said dispensing element is in its closed position.

The outer skirt of said closure body has an upper rim with a recess region, and a tamper evident band is positioned within or at least partly within said recess region, wherein said tamper evident band is attached to said upper rim via at least one, and preferably two to four, frangible connections. Said tamper evident band can be removed from said dispensing closure and can be detached from said closure body only by destroying these frangible connections. The frangible connections thereby serve as connections having a predetermined breaking point.

The tamper evident band is therefore a tamper-evident element, which indicates to the user whether the dispensing element has been switched or pivoted at least once into its dispensing position (or at least out of its closed position) or not. As mentioned above, this tamper evident band or element is different from a tamper evident element, which indicates whether the dispensing closure has been removed from the container or neck.

According to the present invention the dispensing element has an upper surface and an extension portion (or "roof portion" or "overlap"), said extension portion or roof portion extending outwardly, i.e. in a lateral direction, in case of an essentially circular cross-section of such a closure substantially radial direction, at least partly over said upper rim in at least part of said recess region of said upper rim, wherein said tamper evident band is positioned in said recess region at least partly between, essentially in a vertical direction, said upper rim and said extension portion of said upper surface. The extension portion or roof portion therefore extends laterally, in a sideward direction, beyond the remaining side surface or lateral surface of said dispensing element, thereby essentially forming a sideward or lateral extension.

The tamper evident band is constructed and positioned such that the dispensing element cannot be pivoted into its dispensing position without removing the tamper evident element at least partly and at least such that at least one of the frangible connections is destroyed.

The dispensing element can preferably be pivoted from its closed position into its dispensing position by pushing said extension portion or roof portion downwards, i.e. in the direction of the rim in the area of the recess region, such that said extension or roof portion is moved essentially in a vertical direction downwards, but due to the pivotal connection of the dispensing element to said closure body, the extension or roof portion moves on a segment of a circular path around the pivotal axis, but mainly in a vertical downward direction.

If the tamper evident element is still in its original place, i.e. attached to said closure body, preferably at the upper rim in the recess portion, the tamper evident band is positioned between the lower area of the extension portion or roof portion and the upper area of the outer skirt in the area of the recess region of said upper rim, so that the dispensing element cannot be pushed downwards, in a direction to the rim, at a part of said extension portion or roof portion, so that a pivoting of the expensing lid is not possible. In other words, the tamper evident band is positioned in said recess region between the upper rim and the lower surface of said extension or roof portion, extending, in a vertical direction, to an extent that it is not possible to decrease the distance between said upper rim and said lower surface of said roof region to an extent that would allow to switch or move the dispensing element into its dispensing position.

Only after removing the tamper evident band, the extension portion or roof portion of the expensing lid can be pushed in a downward direction by the user, thereby pivoting the dispensing element into its dispensing position.

The dispensing closure according to the present invention therefore provides a very reliable and easily operable dispensing closure, whereas the tamper evident band provides two functions, namely both a locking function, preventing an erroneous or undesired switching or pivoting of the dispensing element into its dispensing position, e.g. during initial transport, before the tamper evident band has been removed, and it provides a reliable tamper evident indication, indicating to the user whether the dispensing element has been switched into its dispensing position at least once or whether this has not yet happened, while such a tamper evident band does not interfere at all with the other functions of the dispensing closure.

A further major advantage of the dispensing closure is that any possibly remaining parts (rupture parts or rupture areas) of the frangible connection of the tamper evident element, after it has been removed, are in a region of the dispensing closure, namely in a recess region of the upper rim, which are normally not touched by a user, when said dispensing element is in its closed position, as the recess region is relatively small. Furthermore, these possibly remaining parts or rupture parts of the frangible connection are covered by said extension portion or roof portion, when the dispensing element is pushed into its dispensing position. This has the advantage that these remaining or rupture parts cannot be touched or hardly be touched by a user, which otherwise could lead to an unpleasant feeling for the user, as these remaining or rupture parts of the frangible connections may be sharp and have edges.

The tamper evident element integrates perfectly into the dispensing closure and does not extend beyond the dimensions of the other elements of the dispensing closure, especially the outer skirt and the maximum lateral extension of the closure body and the top surface of the dispensing element or the upper rim of said outer skirt, so that also an undesired removal or partial removal or a damage of the tamper evident element or the frangible connections is avoided.

Also after the tamper evident band has been removed, the outer appearance of the dispensing closure is undisturbed, whereas further a situation, in which a user comes into contact with any possible remaining or rupture parts of a frangible connection, to which the tamper evident element had been attached, is avoided or at least its likelihood is remarkably reduced.

In a preferred embodiment the discharge opening of the dispensing element is closed by the outer skirt, when said dispensing element is in its closed position, so that it is avoided that any medium is dispensed out of that closure when said dispensing element is in its closed position, even if some medium has already left the container and has entered some parts of the dispensing closure, for example a passageway of the closure body or other elements of said dispensing element, e.g. a dispensing channel.

According to a preferred solution, the dispensing element also comprises a dispensing channel, which is connected with said discharge opening, wherein preferably said dispensing channel is disconnected or separated from said passageway of said closure body, when said dispensing element is in its closed position, so that flowable medium is prevented from entering into said dispensing channel or certain parts thereof when said dispensing element is in its closed position. Preferably this feature is realized in combination with the above-mentioned feature, according to which said dispensing opening is closed by said outer skirt when said dispensing element is in its closed position.

According to a preferred embodiment, the upper surface of the dispensing element does not extend beyond the upper rim, in a vertical direction, when said dispensing element is in its closed position. When therefore the dispensing element is in its closed position, the closure provides an essentially flat upper surface, formed preferably both by the upper rim of the outer skirt (in those areas, where there is no recess region) and the upper surface of said dispensing element.

This has the effect that inadvertent tampering with the dispensing closure, especially undesired opening, is prevented, furthermore the outer optical appearance of the closure is improved.

According to a preferred embodiment, there is a depression provided in the upper surface of said dispensing element, while this depression is preferably arranged in an area inwardly of said extension portion or roof portion of said dispensing element. This depression serves as a pushing area for a finger of a user, so that the user can place his finger into said depression and therefore also onto the extension portion or roof portion of said dispensing element, thereby providing a reliable positioning of the finger, so that the user can easily push down the extension portion or roof portion thereby pivoting the pivotable dispensing element from its closed position into its dispensing position.

Preferably the depression extends at least in one area or region, outwardly into the maximum lateral extension of the dispensing element and into the recess region of the outer skirt, preferably in the vicinity of the extension portion or roof portion. Such a realization of the depression enables the user to more easily grab a part of the tamper evident band, which is positioned in said recess, so that the tamper evident band can be more easily removed by the user.

In a preferred embodiment however, the tamper evident band does not extend vertically above the upper rim of said skirt and also preferably not above the top surface of the dispensing element in order to avoid an inadvertent removing of the tamper evident element, e.g. during transport.

The tamper evident band is preferably dimensioned and positioned such that at least one end of the tamper evident band ends in the vicinity of the depression where this depression extends outwardly into said recess region, so that the tamper evident band can be more easily manipulated by the user in order to detach the tamper evident band from the closure body.

Preferably the tamper evident band does also not extend beyond the lateral dimensions of the closure body and especially the outer skirt of the closure body, in order to avoid an inadvertent removing of the tamper evident band, e.g. during transport of a container to which a dispensing closure according to the present invention is attached.

Preferably the extension portion or roof portion of said dispensing element is arranged such that when said dispensing element is in its dispensing position, it covers any potentially remaining or rupture parts of said frangible connections, being destroyed when said tamper evident band has been removed. The extension portion or roof portion therefore covers remaining material of the frangible connections after destruction thereof, which potentially have edges or sharp parts, so that it is avoided that the user comes into contact with these parts, especially when switching the dispensing element into its dispensing position by pushing said extension or roof portion.

According to a preferred embodiment, the extension portion or roof portion also provides at least one cavity at its lower side, so that these remaining parts of the frangible connections can also enter into these cavities when said dispensing element is in its dispensing position.

This has the advantage that in case the remaining parts of the frangible connections are longer than in average expected, the dispensing element can nevertheless be fully switched or pivoted into its dispensing element, so that a controlled switching or pivoting angle between closed position and dispensing position of said dispensing element is determined and always achieved.

In one embodiment the tamper evident element comprises at least one, preferably 2 to 4, pin extensions on its upper side, whereas the extension portion or roof portion of said dispensing element comprises at least one corresponding through hole, preferably 2 to 4 through holes, whereas the pin extensions and the through holes are dimensioned and arranged such that the at least one pin extension extends at least partly into a corresponding through hole, when said tamper evident band is still in its original position and the dispensing element is in its closed position.

This has the advantage that the pin extensions are visible for the user through said through holes of said dispensing element, so that these visible pin extensions serve as a marker, indicating to the user that the dispensing closure has not yet been opened for the first time, even if looking onto the dispensing closure only from a top side, so that the tamper evident band is otherwise not visible.

The present invention also refers to a container to which a dispensing closure as described above is attached.

The dispensing closure can be attached to the container by different means, e.g. by screwing it onto a container by means of corresponding threads, but also other means are possible, like e.g. in snap-on closures.

However, it is also possible that a dispensing closure as described above is integrally formed with a respective container, e.g. by injection molding. In this case preferably the closure body is injection molded together with the container or parts of the container.

Preferably, the lateral form, especially a cross-sectional form, and/or the lateral dimensions of the container are similar to the lateral dimensions of the dispensing closure, so that the outer appearance of the complete device is mainly unitary, also avoiding that inadvertently the dispensing closure is detached from the container.

The present invention also relates to a manufacturing method, wherein the body closure is manufactured, e.g. by injection molding, together with the tamper evident band being attached to the body closure, but separately from said dispensing element, which is also manufactured preferably by injection molding but in a separate step. After injection molding of the closure body (with the tamper evident band) and the dispensing element, these two elements are assembled in order to form the dispensing closure according to the present invention.

BRIEF DESCRIPTION OF THE DRAWINGS

The above-mentioned features and advantages will become more apparent in view of the following drawings, showing preferred embodiments of the dispensing closure according to the present invention.

DETAILED DESCRIPTION OF THE PREFERRED EMBODIMENTS

Figure 1:
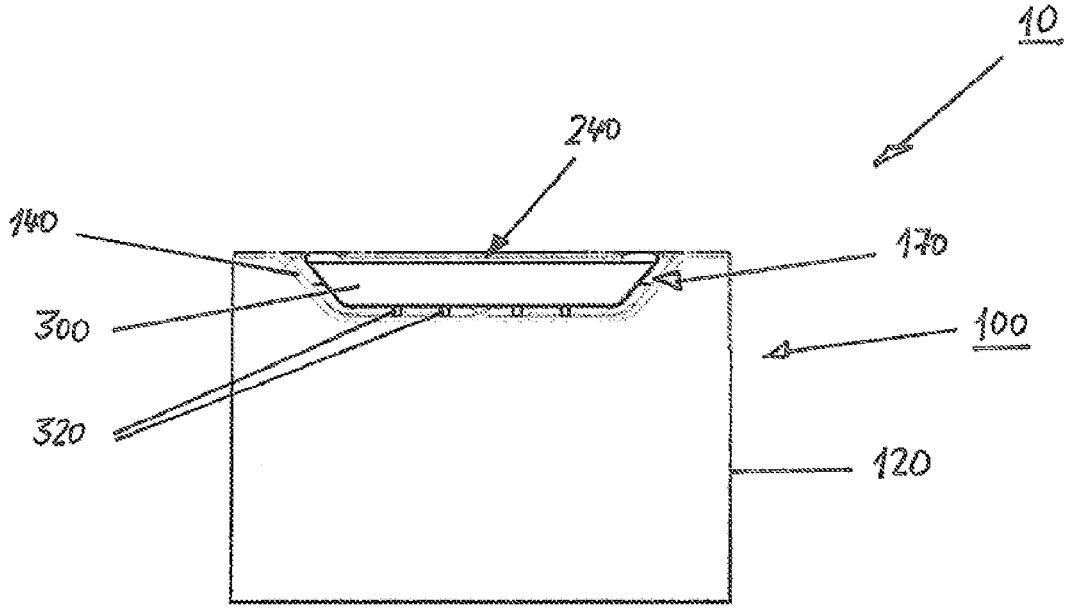
FIG. 1 shows a side view, from a front side, of an embodiment of the dispensing closure according to the invention.
Figure 3:
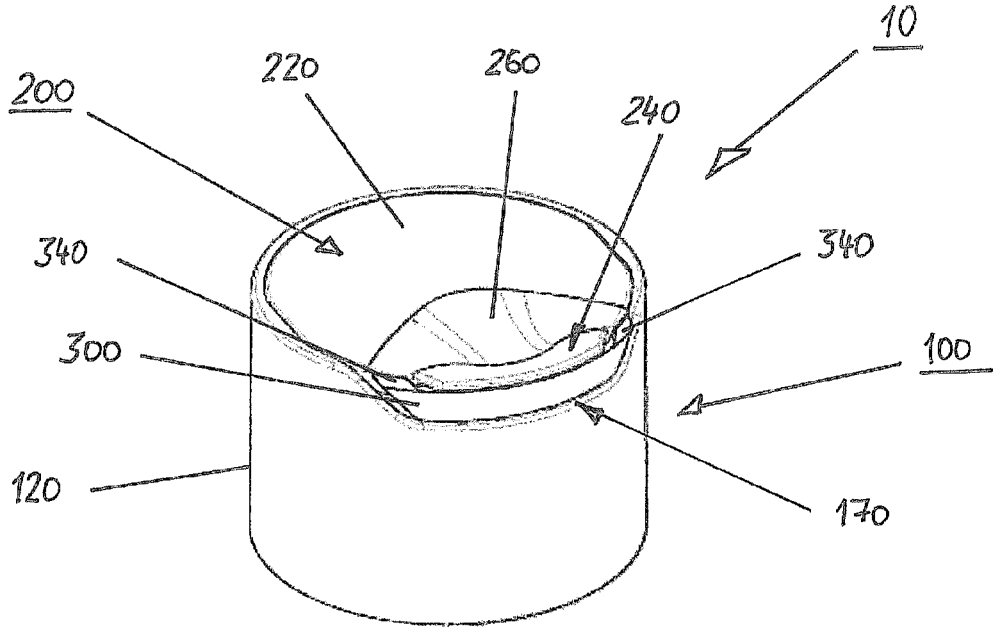
FIG. 3 shows a perspective view of the closure of the embodiment shown in FIG. 1.
Figure 4:
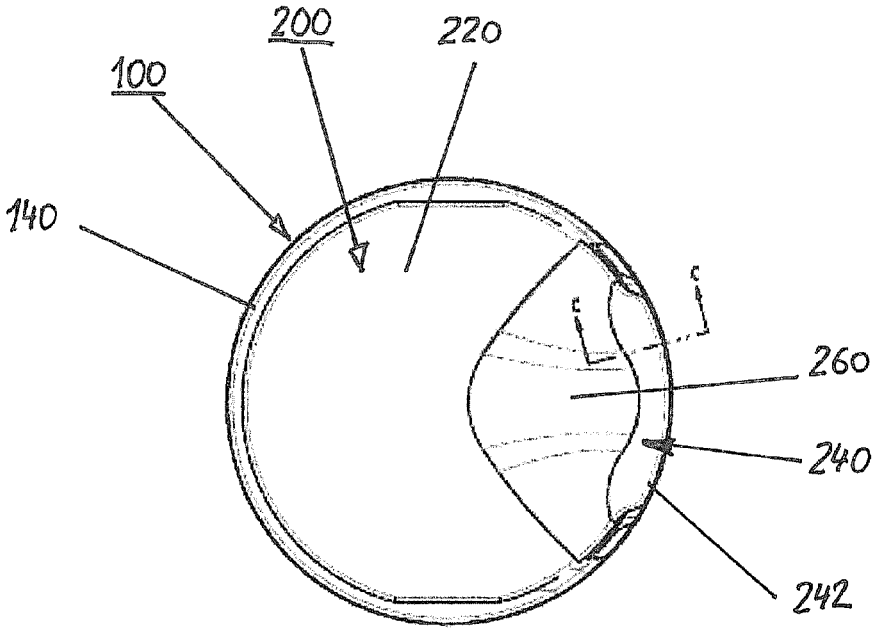
FIG. 4 shows a top view of the embodiment of the dispensing closure of FIG. 1.

FIG. 1 shows an embodiment of a dispensing closure 10 comprising a closure body 100 having an outer skirt 120 and a dispensing element (200, see especially FIGS. 3 and 4). The dispensing closure 10 comprises a tamper evident band 300, which is attached via frangible connections 320 to said closure body 100, more precisely attached to an upper rim 140 of said closure body 100, within a recess region 170, in which the maximum vertical height of the upper rim 140 of the outer skirt 120 is reduced when compared to the other parts of the upper rim 140.

The dispensing closure 10 has an essentially cylindrical form with a cylindrical outer skirt 120. However, also other forms can be realized, the skirt may e.g. have an essentially oval cross-section or a rectangular cross section or other forms.

The recess region in this embodiment extends over an angular range of about 90°, preferred angular ranges are typically between 45° and 120°, preferably between 60° and 100°.

The tamper evident band 300 extends essentially over the whole angular range of the recess region 170, and it has two end portions 340, which do extend vertically more upwards than the other parts of the tamper evident band 300, and which are positioned beside an extension portion or roof portion 240 (see especially also FIG. 3) which does form a lateral extension of the dispensing element 200.

FIG. 3 shows a perspective view of the dispensing closure 10, whereas in FIG. 3 especially the dispensing element 200 is very well visible. The dispensing element 200 has a flat upper surface 220, in which a depression 260 is formed in. The depression 260 is positioned inwardly from an extension portion or roof portion 240, and the depression 260 also extends into the outer area of the flat surface 220 of the dispensing element 200 such that it extends until reaching the maximum lateral extension of the dispensing element 200, so that it extends into the recess region 170 of the outer skirt 120.

Figure 2:
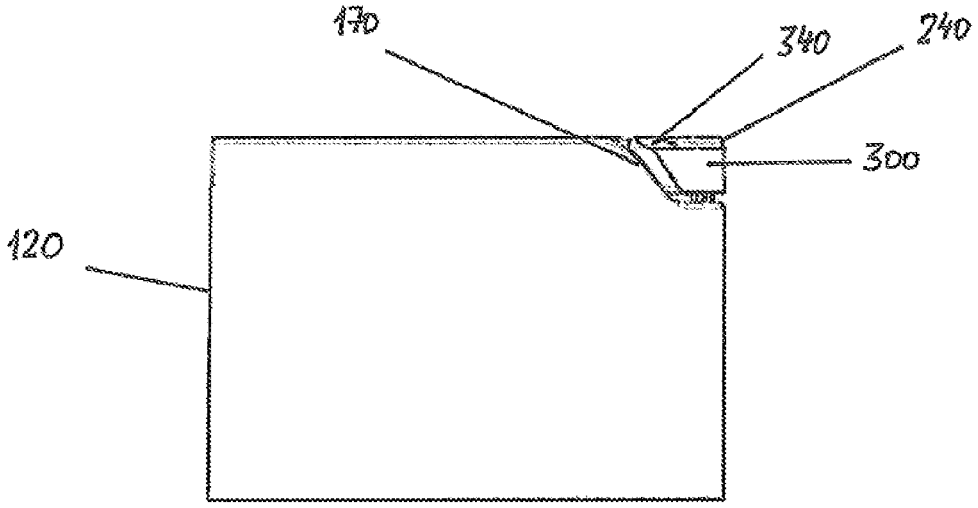
FIG. 2 shows a side view, from the right side, of a dispensing closure as shown in FIG. 1.

The extension or roof portion 240 has an upper surface 242, which is, in a vertical direction, at the same height as the upper surface 220, so that the dispensing closure 10 has an essentially complete flat upper surface, as can be also well seen in FIGS. 1 and 2, with the exception of the depression 260.

The tamper evident band 300 is positioned in the recess region 170 and between the upper rim 140 of the outer skirt 120 and the extension or roof portion 240 of the dispensing element 200, which has the effect that even when a force is exerted downwardly on the depression 260 or on the extension or roof portion 240 by a user, the dispensing element 200 cannot be pivoted relative to the closure body 100 and cannot be moved into its dispensing position.

When a user wants to open the dispensing closure, he can grip one of the ends 340 of the tamper evident band 300, which are, due to the specific arrangement of the depression 260, easy to grab for the user. When tearing away the tamper evident band 300, the frangible connection 320, see especially FIG. 1, are destroyed, so that then the dispensing element 200 can be pivoted into the dispensing position (see also FIG. 8).

FIG. 4 shows a top view of the embodiment shown in FIG. 3, where especially the arrangement of the outer skirt 120 and its upper rim 140 as well as the form of the depression 260 and the extension or roof portion 240 can be seen.

Figure 5:
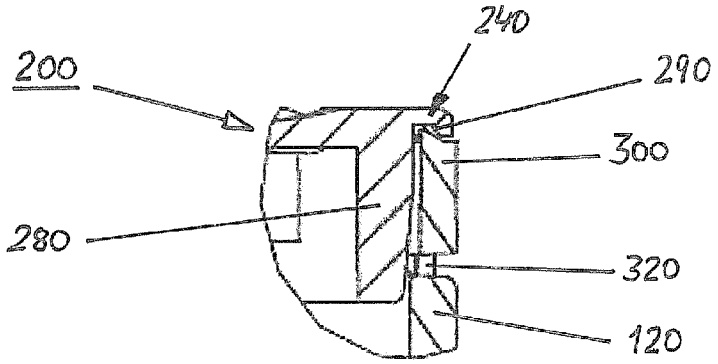
FIG. 5 shows a partial cross-section of the embodiment shown in FIG. 4 along the line C-C.

FIG. 5 shows a cross-section along the line C-C shown in FIG. 4. As can be well seen in FIG. 5, the tamper evident band 300 is arranged between the upper rim 140 of the outer skirt 120 and the extension or roof portion 240, so that it prevents a downward movement of the dispensing element in this area, in other words prevents a downward movement of the extension or roof portion 240, thereby preventing that the dispensing element is moved into its dispensing position. Only after a removing of the tamper evident band 300, which leads to a destruction of the frangible connections 320, the dispensing element 200 can be moved in its dispensing position.

Figure 6:
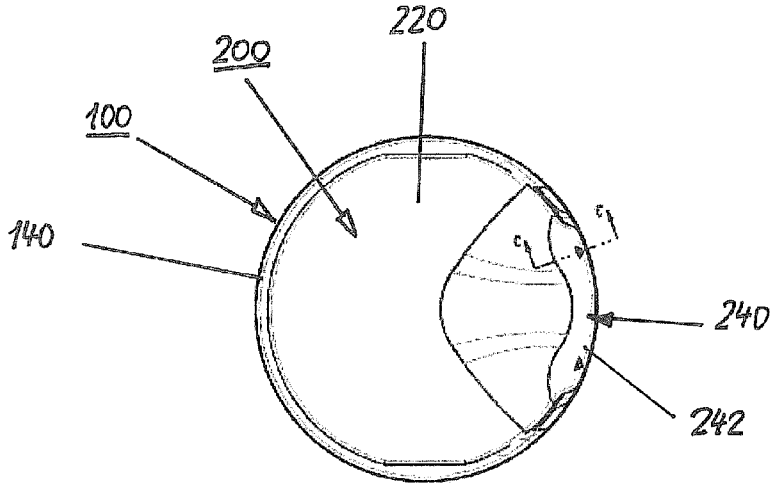
FIG. 6 shows a top view of an alternative embodiment of a dispensing closure according to the invention.

FIG. 6 shows a top view of an alternative embodiment of the present invention, which is very similar to the embodiment shown in FIGS. 1 to 5.

Figure 7:
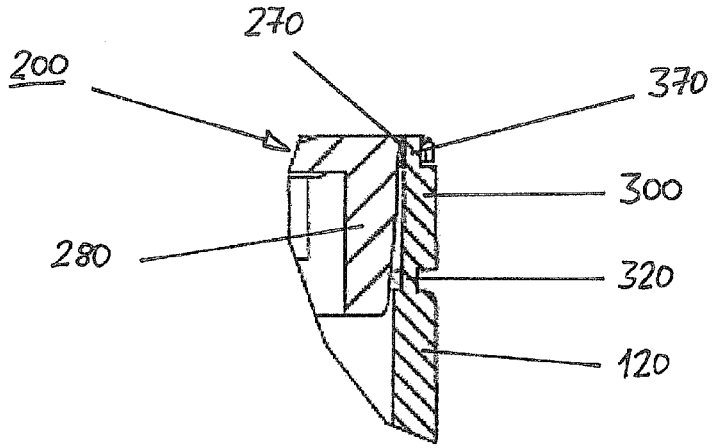
FIG. 7 shows a partial cross-section of the embodiment of the dispensing closure as shown in FIG. 6.

However, contrary to the embodiments shown in FIGS. 1 to 5, see especially FIG. 4, the extension or roof portion 240 has two through holes 270, and, as can be seen especially in FIG. 7, the tamper evident band 300 comprises two corresponding pin extensions 370, which extend into these through holes 270.

The upper surfaces of the pin extensions 370 are therefore visible when looking onto the dispensing closure from a top side, as shown in FIG. 6, so that also from this perspective it can be well seen whether the tamper evident band 300 is still in place or not.

As can be seen in FIG. 7, in this embodiment the extension pins 370 have such a length that their upper surface is on the same height as the upper surface of the extension or roof portion 240 and on the same height as the upper surface 220 of the dispensing element 200, so that also in this area a flat total surface is achieved.

As can be seen both in FIG. 5 and in FIG. 7, the dispensing element 200 also comprises lateral sidewalls 280, which are essentially circular.

Figure 8:
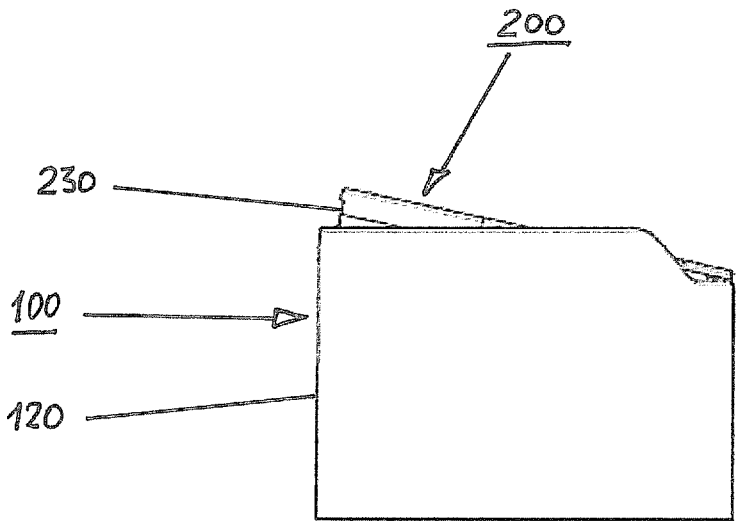
FIG. 8 shows a side view of an embodiment of the dispensing closure, where the dispensing element is in its dispensing position.

FIG. 8 shows a side view of an embodiment of a dispensing closure according to the present invention, wherein the dispensing element 200 is in its dispensing position, i.e. it is pivoted relative to the closure body 100 by a predetermined angle, which is preferably between 5° and 25°, more preferably between 10° and 20°.

In this dispensing position, a discharge opening 230 is open to the outside, so that a medium can be dispensed through this discharge opening 230.

Figure 9:
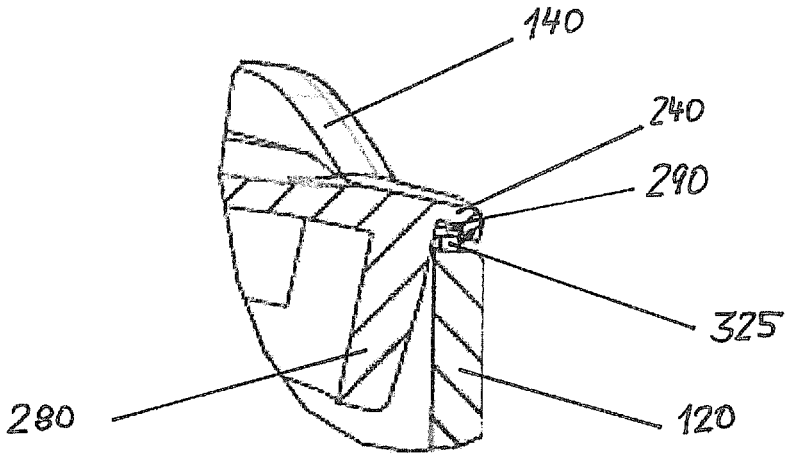
FIG. 9 shows a partial cross-section of an embodiment of the dispensing closure as shown in FIG. 3 with the dispensing element in its dispensing position.

FIG. 9 shows a partial cross-sectional view through an embodiment of the dispensing closure 10, similar to the cross-sectional views shown in FIG. 5 and FIG. 7, however with the dispensing element 200 in its dispensing position.

As can be well seen in FIG. 9, the dispensing element 200 is pivoted relative to the closure body 100, so that the region of the dispensing element 200, shown in FIG. 9, is moved downwards relative to the position shown in FIG. 5 and FIG. 7.

The tamper evident band has been removed, but there are still rupture points 325 present on the upper rim 140, which is remaining material from the frangible connections.

In this embodiment, the extension or roof portion 240 has, at its lower side, a cavity 290, which is positioned and dimensioned such that the rupture points 325 (or multiple rupture points or rupture areas) are not only covered by the extension or roof portion 240, but the rupture points 325 even partly extend into this cavity 290. This has the advantage that these potentially sharp rupture points are covered and that a user cannot inadvertently touch these rupture points or even hurt himself.

Figure 10:
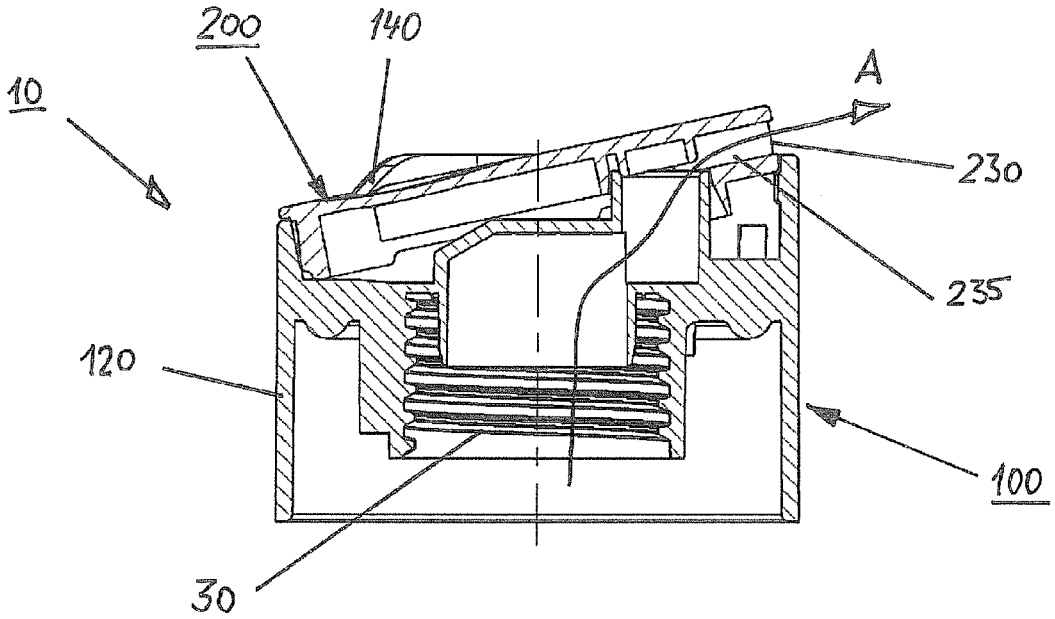
FIG. 10 shows a cross-section through an embodiment of the dispensing closure according to the invention, with the dispensing element being in its dispensing position.

FIG. 10 shows a cross-section through an embodiment of the dispensing closure 10 with its dispensing element 200 being in its dispensing position, so that the discharge opening 230 is opened to the outside.

As can be well seen, a medium can be dispensed through a passage way, being indicated with an arrow A extending through a closure portion of said closure body 100 and through a channel 235 in the dispensing element 200 through that said discharge opening 230. As can be also well seen in FIG. 10, the specific embodiment of a dispensing closure 200 has an inner thread 30 for an attachment to a corresponding outer thread at a neck of a container (not shown).

Figure 11:
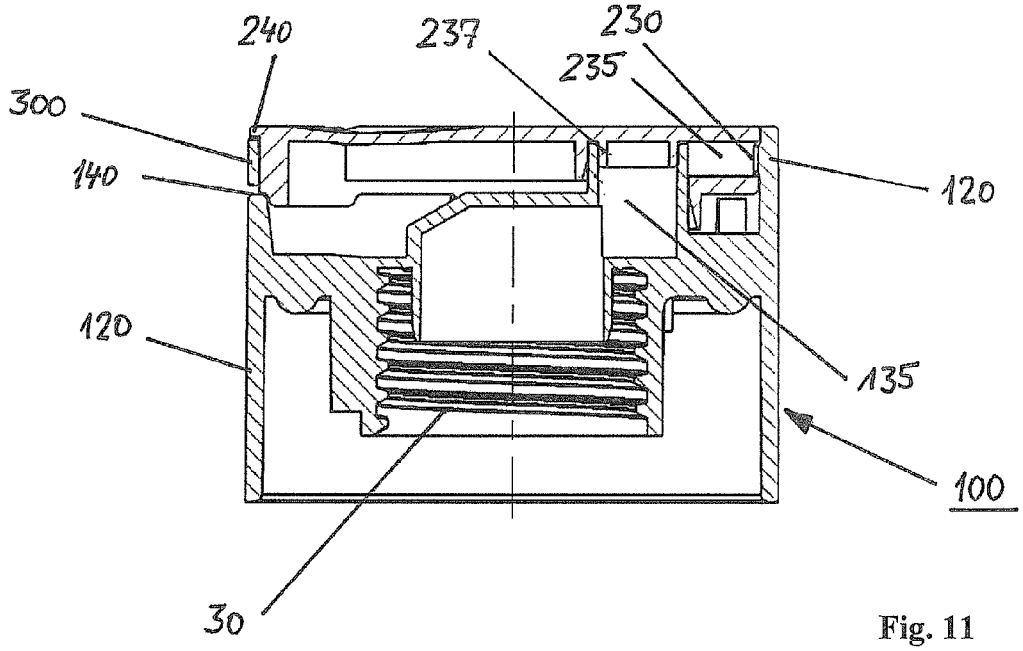
FIG. 11 shows a cross-section through an embodiment of the dispensing closure according to the invention, with the dispensing element being in its closed position.

FIG. 11 shows a cross-section through the embodiment of the dispensing closure 10 as shown in FIG. 10, however, with its dispensing element 200 being in its closed position.

As can be well seen in FIG. 11, the discharge opening 230 is now closed by said outer skirt 120, so that no liquid can be dispensed.

Furthermore, in this embodiment, the dispensing element 200 contains a cylinder-like extension 237, which fits into a part of said passageway of said closure portion of said closure body 100, thereby also blocking the passageway and thereby also avoiding that further medium can enter into said channel 235 of the dispensing element 200 being arranged before the discharge opening 230.

This specific realization therefore realizes a secure closing of the dispensing closure, even if a pressure should be exerted onto the container when said dispensing element is in its closed position.

Furthermore, FIG. 11 also very well shows the positioning of the tamper evident band 300, being arranged, in a vertical direction, between the extension or roof portion 240 and the upper rim 140 of the outer skirt 120. In this respect, it has to be noted that the frangible connections are not visible in this cross section, as being located at different (angular) positions between the tamper evident band 300 and the upper rim 140 of the outer skirt 120.

As explained above, it is therefore not possible to pivot or switch the dispensing element 200 into its dispensing position, as long as the tamper evident band 300 is still in its place, i.e. attached to the closure body 100.

The features disclosed in the above description, the figures and the claims can be significant for the realization of the invention in the different embodiments either alone or in combination.

What is claimed is:

1. A dispensing closure (10) being attachable to a container for dispensing a flowable medium from said container, comprising:

a closure body (100) having an outer skirt (120) and a closure portion extending from an inside of said outer skirt (120), wherein said closure portion comprises a passageway for dispensing said flowable medium;

a dispensing element (200) being attached to said closure body (100) and being pivotable relative to said closure body (100) between a closed position and a dispensing position, said dispensing element (200) having a discharge opening (230); and a tamper evident band (300);

wherein said closure body (100) and said dispensing element (200) are constructed such that a medium can be dispensed through said passageway of said closure portion of said closure body (100) and through said discharge opening (230) of said dispensing element (200), when said dispensing element (200) is in said dispensing position, and such that a medium cannot be dispensed, when said dispensing element (200) is in said closed position;

wherein said outer skirt (120) has an upper rim (140) with a recess region (170), said tamper evident band (300) is positioned in said recess region (170) and is attached to said upper rim (140) via at least one frangible connection;

wherein said dispensing element (200) has an upper surface (220) and an extension portion extending outwardly at least partly over said upper rim (140) in at least part of said recess region (170) of said upper rim (140), wherein said tamper evident band (300) is positioned in said recess region (170) at least partly between said upper rim (140) and said extension portion of said dispensing element (200); and wherein said upper surface (220) of said dispensing element (200) comprises a depression region, which at least at one point extends outwardly into the recess region (170) of said outer skirt (120).

2. The dispensing closure (10) according to claim 1, wherein said tamper evident band (300) is configured and positioned such that one end (340) of the tamper evident band (300) is positioned within said recess region (170) of said outer skirt (120) proximal to the position where the depression region of said upper surface (220) of said dispensing element (200) extends into said recess region (170) of said upper rim (140) of said outer skirt (120).

3. A dispensing closure (10) being attachable to a container for dispensing a flow able medium from said container, comprising:

a closure body (100) having an outer skirt (120) and a closure portion extending from an inside of aid outer skirt (120), wherein said closure portion comprises a passageway for dispensing said flowable medium;

a dispensing element (200) being attached to said closure body (100) and being pivotable relative to said closure body (100) between a closed position and a dispensing position, said dispensing element (200) having a discharge opening (230); and a tamper evident band (300);

wherein said closure body (100) and said dispensing element (200) are constructed such that a medium can be dispensed through said passageway of said closure portion of said closure body (100) and through said discharge opening (230) of said dispensing element (200), when said dispensing element (200) is in said dispensing position, and such that a medium cannot be dispensed, when said dispensing element (200) is in said closed position;

wherein said outer skirt (120) has an upper rim (140) with a recess region (170), said tamper evident band (300) is positioned in said recess region (170) and is attached to said upper rim (140) via at least one frangible connection;

wherein said dispensing element (200) has an upper surface (220) and an extension portion extending outwardly at least partly over said upper rim (140) in at least part of said recess region (170) of said upper rim (140), wherein said tamper evident hand (300) is positioned in said recess region (170) at least partly between said upper rim (140) and said extension portion of said dispensing element (200); and wherein said extension portion of said dispensing element (200) has a lower surface with at least one cavity (290) being configured and positioned such that said at least one cavity (290) covers at least one rupture point (325) of said at least one frangible connection after said tamper evident band (300) has been removed, when said dispensing element (200) is in said dispensing position.

4. A dispensing closure (10) being attachable to a container for dispensing a flowable medium from said container, comprising:

a closure body (100) having an outer skirt (120) and a closure portion extending from an Inside of said outer skirt (120), wherein said closure portion comprises a passageway for dispensing said flowable medium;

a dispensing element (200) being attached to said closure body (100) and being pivotable relative to said closure body (100) between a closed position and a dispensing position, said dispensing element (200) having a discharge opening (230); and a tamper evident band (300);

wherein said closure body (100) and said dispensing element (200) are constructed such that a medium can be dispensed through said passageway of said closure portion of said closure body (100) and through said discharge opening (230) of said dispensing element (200), when said dispensing element (200) is in said dispensing position, and such that a medium cannot be dispensed, when said dispensing element (200) is in said closed position;

wherein said outer skirt (1201 has an upper rim (140) with a recess region (170), said tamper evident hand (300) is positioned in said recess region (170) and is attached to said upper rim (140) via at least one frangible connection;

wherein said dispensing element (200) has an upper surface (220) and an extension portion extending outwardly at least partly over said upper rim (140) in at least part of said recess region (170) of said upper rim (140), wherein said tamper evident band (300) is positioned in said recess region (170) at least partly between said upper rim (140) and said extension portion of said dispensing element (200); and wherein said tamper evident band (300) comprises at least one pin extension (370) and wherein said extension portion of said dispensing element (200) has at least one corresponding through hole (270), said pin extension (370) and said through hole (270) being arranged and configured such that said pin extension (370) at least partly extends into said through hole (270) when said dispensing element (200) is in said closed position and when the tamper evident band (300) is still attached to said closure body (100).

* * * * *